US010876807B2

(12) United States Patent
Christandl et al.

(10) Patent No.: US 10,876,807 B2
(45) Date of Patent: Dec. 29, 2020

(54) SILENCER FOR A HANDGUN

(71) Applicant: Dieter Christandl, Weiz (AT)

(72) Inventors: Dieter Christandl, Weiz (AT); Oliver Fischer, Hard (AT)

(73) Assignee: Dieter Christandl, Weiz (AT)

( * ) Notice: Subject to any disclaimer, the term of this patent is extended or adjusted under 35 U.S.C. 154(b) by 0 days.

(21) Appl. No.: 16/541,679

(22) Filed: Aug. 15, 2019

(65) Prior Publication Data

US 2020/0003515 A1 Jan. 2, 2020

Related U.S. Application Data

(63) Continuation of application No. PCT/EP2018/051991, filed on Jan. 26, 2018.

(30) Foreign Application Priority Data

Feb. 15, 2017 (DE) ..... 10 2017 103 010

(51) Int. Cl.
*F41A 21/30* (2006.01)
*F41A 21/32* (2006.01)

(52) U.S. Cl.
CPC ..... *F41A 21/30* (2013.01); *F41A 21/325* (2013.01)

(58) Field of Classification Search
CPC ..... F41A 21/30; F41A 21/32; F41A 21/325
USPC ..... 89/14.4; 181/223
See application file for complete search history.

(56) References Cited

U.S. PATENT DOCUMENTS 4,479,418 A 10/1984 Beretta
4,944,213 A * 7/1990 Ewert ..... F41A 21/325 89/14.3
5,136,924 A * 8/1992 Forster ..... F41A 21/30 89/14.4
7,194,836 B1 * 3/2007 Urban ..... F41C 27/22 42/106
10,161,704 B1 * 12/2018 Lee ..... F41G 11/003
10,254,085 B2 4/2019 Willmann et al.
10,480,887 B2 * 11/2019 Fischer ..... F41A 21/30
(Continued)

FOREIGN PATENT DOCUMENTS

DE 10 2013 107 115 A1 8/2014
DE 10 2015 102 477 A1 8/2016

OTHER PUBLICATIONS

International Search Report issued for corresponding International Patent Application No. PCT/EP2018/051991, dated Apr. 16, 2018.

*Primary Examiner* — Bret Hayes
(74) *Attorney, Agent, or Firm* — Myers Wolin, LLC

(57) ABSTRACT

A silencer is provided for a handgun, in particular a pistol, where the silencer has a fastening adapter and a silencer housing. The fastening adapter has a fastening rail with two mutually parallel longitudinal guides for fastening the fastening adapter to a mounting rail of the handgun and a fastening plate arranged at the front end substantially perpendicular to the longitudinal axis of the longitudinal guides. The silencer housing is preferably releasably fastened on the fastening plate a shot channel is formed in the silencer housing, and in the fastened state of the silencer housing (20) on the fastening plate (31) the longitudinal axis of the shot channel is inclined by an angle (α) of between 0.2° and 1.4° relative to the longitudinal axis of the longitudinal guides of the fastening rail.

11 Claims, 4 Drawing Sheets

(56) References Cited

U.S. PATENT DOCUMENTS

2015/0362276 A1 12/2015 Fischer
2018/0292161 A1* 10/2018 Christandl ..... F41A 21/325

* cited by examiner (b)

(a)

SILENCER FOR A HANDGUN

CROSS REFERENCE TO RELATED APPLICATIONS

The present application is a continuation of International Application No. PCT/EP2018/051991, filed on Jan. 26, 2018, and claims priority of German Application No. 10 2017 103 010.7, filed on Feb. 15, 2017, the contents of which are incorporated herein by reference.

FIELD OF THE INVENTION

The invention relates to a silencer for a firearm, in particular handgun and a firearm, in particular handgun with a silencer according to the invention.

BACKGROUND OF THE INVENTION

The term "handguns" means handguns, such as recoil-operated weapons, gas-operated weapons, pistols or the like. The invention is described using the example of a handgun or pistol, although the present invention is not limited thereto and can also be used in long weapons.

It is known to equip firearms with a silencer to reduce the noise emission emanating from the high-pressure and explosively expanding gases emitted during the shot from the muzzle.

For handguns with a movable or backward-tipping barrel, the maintenance of the self-loading function of the weapon proves to be problematic if a silencer is attached to the barrel. Because a silencer screwed onto the barrel or the breech increases the mass returning during the shot, as a result of which the return speed of the barrel and breech decreases. This can have the consequence that either the self-loading function of the weapon is completely omitted or a malfunction may result, because for example the ejection of the cartridge case and/or the supply of a new cartridge are performed incompletely and the weapon is not fully locked.

In practice, attempts have been made to solve this problem by lighter or smaller silencers. However, this has the disadvantage that with correspondingly lightweight silencers, the stability of the silencer decreases and that with smaller silencers the damping effect is sometimes considerably reduced due to the smaller volume.

One solution to this problem is not to rigidly connect the silencer and the gun barrel, but to place a so-called pulse generator between the silencer and the gun barrel, which permits axial movement of the gun barrel relative to the silencer.

However, the use of pulse generators has the disadvantage that they can easily become contaminated and/or that damage to the threads of the pulse generator can lead to impairment of the function of the firearm. When a gun barrel tilts backwards, the silencer must be raised even when using a pulse generator, which in turn can lead to malfunctions due to the weight of the silencer.

OBJECT OF THE INVENTION

The object of the invention is therefore to provide solutions for an alternative fastening of a silencer to a handgun, in which in particular the self-loading function is not affected in a moving barrel.

INVENTIVE SOLUTION

This object is achieved by a silencer for a handgun and by a handgun with a silencer according to the invention according to the independent claims. Advantageous embodiments and further developments of the invention are specified in the dependent claims.

Accordingly, a silencer for a firearm is provided, in particular for a pistol, wherein the silencer has a fastening adapter and a silencer housing, wherein

- the fastening adapter has
  - a fastening rail with two mutually parallel longitudinal guides for attaching the fastening adapter to a mounting rail of the handgun and
  - a fastening plate arranged at the front end substantially perpendicular to the longitudinal axis of the longitudinal guide,
- the silencer housing is preferably releasably attached to the fastening plate,
- in the silencer housing a shot channel is formed, and
- in the fastened state of the silencer housing to the fastener plate, the longitudinal axis of the shot channel is inclined by an angle $\alpha$ of between 0.2° and 1.4° relative to the longitudinal axis of the longitudinal guides of the fastening rail.

It is particularly advantageous here if

- the fastening plate has
  - a front stop surface and
  - a rear stop surface
  - wherein the rear stop surface faces the weapon barrel of the handgun in the fastened state of the fastening adapter on the fastening rail of the handgun, and
- the silencer housing has a rear end wall, which in the fastened state of the silencer housing to the fastening plate faces the front stop surface of the fastening plate.

The sum of an angle $\beta$ and an angle $\lambda$ ($\beta+\lambda$) may be between 180.2° and 181.4° or between 178.6° and 179.8°, where

- the angle $\beta$ is the angle between the front stop surface and the longitudinal axis of the longitudinal guides, and
- the angle $\lambda$ is the angle between the longitudinal axis of the shot channel and the rear end wall.

Here

- the angle $\lambda$ can be 90°, or
- the angle $\beta$ can be 90°.

In one embodiment of the invention, an angle $\varphi$ between the rear stop surface and the longitudinal axis of the longitudinal guides can be 90°.

In the fastening plate, a shot channel may be provided, wherein the shot channel of the fastening plate

- extends in the attached state of the silencer housing to the fastening plate coaxial with the shot channel of the silencer housing, or
- parallel to the longitudinal axis of the longitudinal guides.

The shot channel of the fastening plate can be made tapering towards the front stop surface and have at the front stop surface substantially the same diameter as the firing channel of the silencer housing.

At the front stop surface, an axial projection can be provided, which engages largely positively in a corresponding recess on the rear end wall of the silencer housing.

On at least one side wall of the axial projection, preferably on the two vertical side walls of the axial projection, boreholes or through-holes corresponding to boreholes on the silencer housing may be provided for receiving fastening means.

It is advantageous if at the rear end of the fastening rail, a support surface is formed, which at least partially rests on a front end of a trigger guard of the firearm when the fastening adapter is attached to the firearm.

In a further embodiment of the invention, the silencer housing can be arranged at a predetermined angle ω relative to the fastening adapter pivotally mounted on the fastening adapter.

Also provided is a handgun, in particular a pistol, with a silencer according to the invention.

BRIEF DESCRIPTION OF THE FIGURES

Further details and features of the invention will become apparent from the following description taken in conjunction with the drawings. In the figures.

DETAILED DESCRIPTION OF THE INVENTION

The silencer according to the invention described below has the advantage that it can be particularly simply, safely and quickly fastened or assembled and disassembled, in particular without screwing to the weapon.

Another important advantage of the silencer according to the invention is that it can also be used for handguns that have a moving barrel. A pulse generator does not have to be used, while the self-loading function of the handgun is still maintained. The use of the silencer according to the invention has proven to be particularly advantageous in this case for handguns which have a returning and tipping barrel.

However, a significant advantage of the silencer according to the invention lies in the fact that they are fastened to a mounting rail of a gun, in which the mounting rail is not parallel to the axis. Nevertheless, this ensures that the shot channel of the silencer extends exactly coaxially with the barrel of the weapon after installation of the silencer on the weapon.

Figure 1:
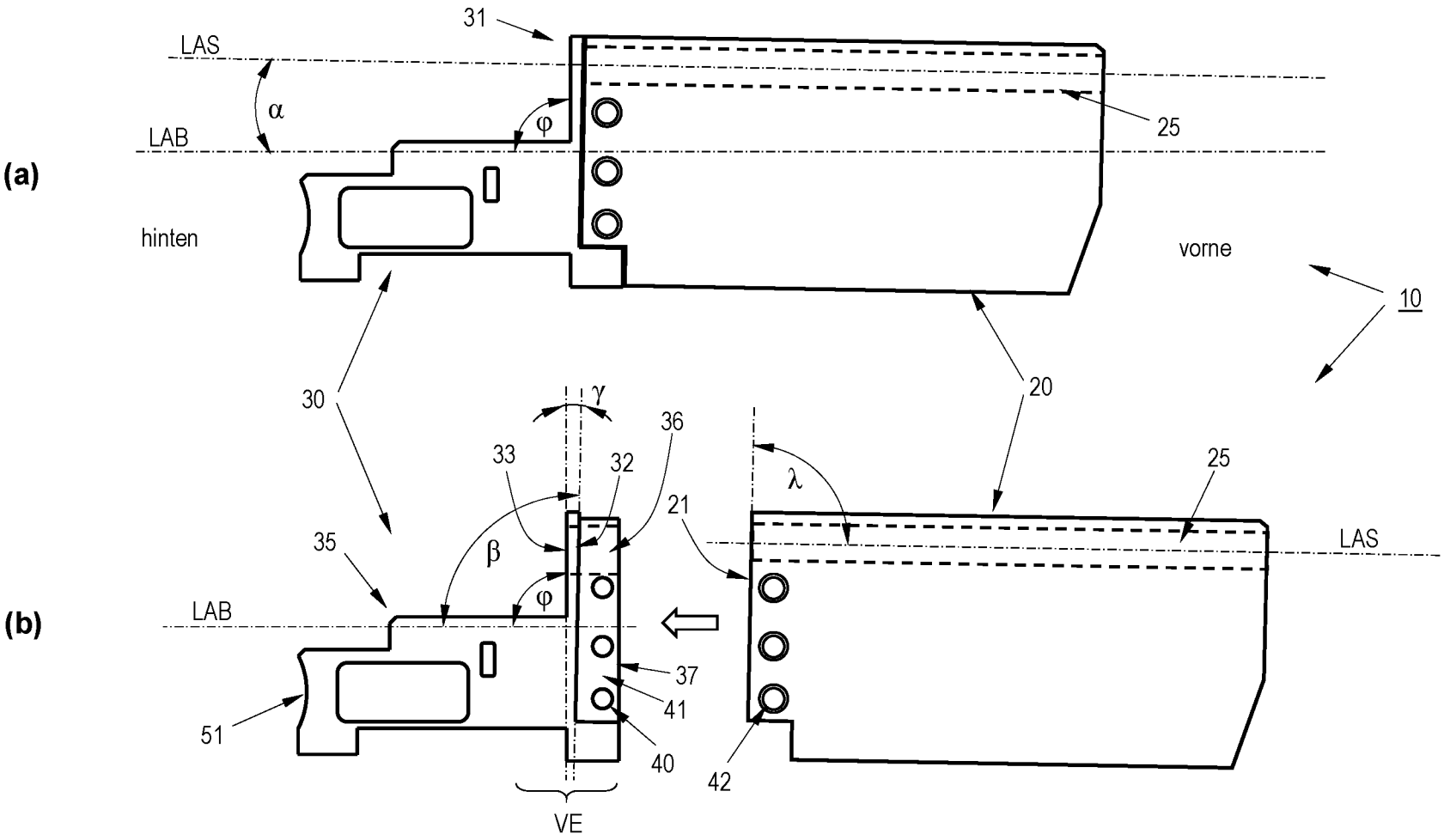
FIG. 1 is a side view of a silencer according to the invention in an assembled state (Figure (a)) and in a disassembled state (Figure (b))

FIG. 1 shows a side view of a silencer 10 according to the invention, wherein in Figure (a) the silencer is shown in the assembled state and in Figure (b) in the disassembled state (silencer housing 20 is separated from the fastening adapter 30). The silencer 10 is thus configured at least in two parts, wherein the silencer housing 20 forms the first part and the fastening adapter 30 forms the second part.

The fastening adapter 30 has a fastening rail 35 and a fastening plate 31.

The fastening rail 30 is pushed onto a mounting rail of the firearm and thus fastened to the weapon. The mounting rail is located at the bottom of the front portion of the handle of the weapon, i.e. below the barrel of the weapon. The fastening rail 35 has two axially extending and spaced-apart side walls, on the inner surfaces of which at least one longitudinal guide 35*a* (clearly visible in FIG. 2) each is provided which can be brought into engagement with the mounting rail of the weapon.

The fastening plate 31 is arranged at the front end of the fastening rail 35 and at the front end portion VE. The fastening plate 31 is substantially perpendicular to the fastening rail 35. The fastening plate 31 and the fastening rail 35 are advantageously designed in one piece. But they can also be designed in two parts to allow a release of the fastening plate 31 from the fastening rail 35. Because of the stability, however, the one-piece design is advantageous.

Due to the substantially vertical arrangement of the fastening plate 31 on the fastening rail 35, the entire fastening adapter 30 has an L-shaped basic shape, wherein the fastening rail 35 forms the one leg of the L-shaped basic shape and the fastening plate 31 forms the other leg of the L-shaped basic shape.

The fastening plate 31 has a front stop surface 32 and a rear stop surface 33, the rear stop surface 33 being the surface facing the forward end of the gun barrel when the silencer 10 is mounted on the weapon. The angle φ between the rear stop surface 33 and the longitudinal axis LAB of the longitudinal guides 35*a* is approximately 90°. Depending on the specific embodiment of the front end of the gun barrel and/or the front end of the handle of the weapon, the angle φ may however also be greater or less than 90°.

After mounting the silencer housing 20 to the fastening adapter 30, a rear end wall 21 of the silencer housing 20 lies on the front stop surface 32 of the fastening plate 31. The angle β between the front stop surface 32 and the longitudinal axis LAB of the longitudinal guides 35*a* is 90.8° in the embodiment shown in FIG. 1. However, the angle β may be between 88.6° and 91.4°, so that the front stop surface 32 is inclined backwards by up to 1.4° relative to the longitudinal axis LAB or is inclined forwards by up to 1.4° relative to the longitudinal axis LAB. The specific angle β depends on the angle λ between the rear end wall 21 of the silencer housing 20 and the longitudinal axis LAS of the shot channel 25 of the silencer housing 20, as shown in detail below.

At the front of the fastening plate 31, an axial projection 37 is provided, which is brought in the mounting of the silencer housing 20 on the fastening adapter 30 in engagement with a recess provided on the rear end wall 21 of the silencer housing 20. Through the axial projection 37, a step is formed between the front stop surface 32 and the axial projection 37, so that the front stop surface 32 forms a stop surface 32 that at least partially surrounds the axial projection, as is clearly visible in FIG. 2, sub-figure (b).

At the two vertical side walls 41 of the projection 37, blind holes 40 or boreholes are provided. Alternatively, through-holes 40 can also be provided which completely traverse the projection 37.

At the portion of the silencer housing 20 which circumscribes the recess, through-holes 42 are likewise provided, which correspond to the bores/holes 40 on the projection 37. The through-holes 42 on the silencer housing 20 and the bores/holes 40 on the projection 37 are used to hold fastening means, such as screws, to fix the silencer housing 20 to the fastening adapter 30.

In the silencer housing 20, a shot channel 25 is provided which traverses the silencer housing in the axial direction. In the silencer housing 20, sound-reducing devices and/or sound-reducing means may be provided, which are optionally traversed by the shot channel 25.

The angle λ between the rear end wall 21 of the silencer housing 20 and the longitudinal axis LAS of the shot channel 25 of the silencer housing 20 is between 88.6° and 91.4°, i.e. the rear end wall 21 can be tilted backwards by up to 1.4° relative to the longitudinal axis LAS or inclined forwards by up to 1.4° relative to the longitudinal axis LAS. Depending on the angle β between the longitudinal axis LAB of the longitudinal guides 35*a* and the front stop surface 32, the angle λ can also be 90°, as shown for example in FIG. 1.

According to the invention, the angle β between the longitudinal axis LAB of the longitudinal guides 35*a* and the front stop surface 32 and the angle λ between the rear end wall 21 of the silencer housing 20 and the longitudinal axis LAS of the shot channel 25 of the silencer housing 20 are selected so that the sum of the two angles β and λ is between 180.2° and 181.4° or between 178.6° and 179.8°. This ensures that the shot channel 25 of the silencer housing 20 is inclined relative to the longitudinal axis LAB of the longitudinal guides 35*a* by between 0.2° and 1.4° upwards or downwards.

It has proven to be advantageous if the sum of the two angles β and λ is approximately 180.8° or 179.2°, so that the shot channel 25 of the silencer housing 20 is inclined upwards or downwards by 0.8° relative to the longitudinal axis LAB of the longitudinal guides 35*a*.

In the silencer shown in sub-figure (a) of FIG. 1, the shot channel 25 is inclined down by 0.8° relative to the longitudinal axis LAB, i.e., the angle α between the longitudinal axis LAB of the longitudinal guides 35*a* and the longitudinal axis LAS of the shot channel 25 is also 0.8°.

The inclination of the shot channel 25 relative to the longitudinal guides 35*a* has the advantage that the silencer 10 can also be attached to a pistol, the mounting rail of which is not parallel to the barrel axis, for example, which is inclined upwards by 0.8°. It is ensured that the shot channel of the silencer runs exactly coaxial with the barrel of the weapon after mounting the silencer on the weapon.

Without the measures according to the invention, the center of the exit opening of the shot channel of a 160 mm long silencer would protrude by approximately 4 mm at the imaginary extension of the barrel axis at a mounting rail inclined by 0.8° relative to the barrel axis, i.e. the exit opening of the shot channel would no longer be concentric with the barrel axis. The consequences would be, inter alia, that firing would be done in the damper package, which can lead to destruction of the damper and possibly to a deviation of the projectile.

This problem could also be circumvented by increasing the diameter of the shot channel of the silencer so far that the axial projection of the muzzle is located within the front opening of the shot channel of the silencer. In the above example, therefore, the diameter of the shot channel of the silencer would have to be increased by 4 mm to ensure that the projectile can pass through the shot channel unhindered. Increasing the diameter, however, involves a reduction in the damping line, so this is not a viable option in practice.

The mounting rail of the weapon is usually provided for attaching weapons accessories, such as a tactical light or the like, but not for fastening a silencer, so that there is no need to align the mounting rail exactly parallel to the gun barrel.

In the conventional technique to fasten silencers to the weapon, i.e. unscrewing the silencer at the front end of the barrel, the longitudinal axis of the shot channel of the silencer always runs coaxially to the barrel axis, so there is no need to adjust the inclination of the shot channel to the barrel axis.

In the silencer 10 shown in FIG. 1, the shot channel is inclined downward by 0.8° relative to the longitudinal axis LAB of the longitudinal guides 35*a* (α=0.8°). This can be compensated for an inclination upward of the mounting rail of 0.8°.

Some gun manufacturers supply pistols in which the mounting rail is tilted at 0.8° relative to the barrel axis under predetermined environmental conditions (temperature and humidity). In the case of changing environmental conditions, it may then happen that this angle of inclination changes, in particular can become smaller than 0°. At an angle of less than 0°, the mounting rail is inclined relative to the barrel axis by this angle downwards.

As explained above, this negative angle can be compensated by the fact that the sum of the angles β and λ is less than 180°, so that the longitudinal axis LAS of the shot channel is inclined upwards relative to the longitudinal axis LAB of the longitudinal guides.

According to the invention, however, such negative inclination angles can also be compensated if the sum of the angles β and λ is greater than 180°, i.e. the longitudinal axis LAS of the shot channel is inclined downwards relative to the longitudinal axis LAB of the longitudinal guides. For this purpose, at the rear end of the fastening rail 35 and at the rear end of the fastening adapter 30, a support surface 50 is provided which comes to rest during assembly of the silencer 10 on the mounting rail of the weapon on the trigger guard of the weapon. During assembly of the silencer, the force with which the support surface 50 is pressed against the trigger guard causes the front portion of the handle (on the underside of which the mounting rail is also located) is pushed up or forced upwards from the front portion of the fastening rail, so that the mounting rail is inclined relative to the barrel axis back up (for example, by 0.8°).

The support surface 50 extends substantially perpendicular to the longitudinal axis of the fastening rail 35. Further, the support surface 50 extends between two wings formed at the rear end of the fastening rail 51, wherein the wings 51 are arranged substantially perpendicular to the support surface 50 and extend parallel to the longitudinal axis of the fastening rail. The two wings 51 protrude on the support surface 50 to the rear.

The support surface 50 itself here has a convexly extending surface and is configured such that it corresponds with a concave surface of the trigger guard and rests substantially flush with the mounted silencer thereon.

The distance between the two wings 51 to each other is selected so that it corresponds substantially to the width of the front end of the trigger guard. When mounting the silencer 10, the front end of the trigger guard comes into engagement between the two wings 51, wherein preferably a positive connection between the wings and the front end of the trigger guard is formed, that is, that the rear end of the fastening rail 35 in the horizontal direction cannot move relative to the trigger guard.

Instead of a convexly extending surface of the support surface 50, the surface of the support surface may have a substantially vertical planar surface. A lower portion of the support surface 50 may be slightly recessed, i.e., a kind of step is formed between the upper portion and the lower portion of the support surface 50. In the lower, i.e. recessed portion engages a correspondingly configured projection of the trigger guard and is advantageously on the surface of the recessed portion. The step formed between the two sections prevents, on the one hand, that the rear end of the silencer can fold down with silencer mounted. On the other hand, this provides the force with which the front end of the fastening rail is pushed upwards.

In the fastening plate 31, a shot channel 36 is provided, which extends in the mounted state of the silencer largely coaxial with the barrel axis. Due to the small length of the shot channel 36, an optionally small inclination of up to 1.4° relative to the barrel axis does not have a negative effect.

The shot channel 36 may be designed to taper towards the front stop surface.

Figure 2:
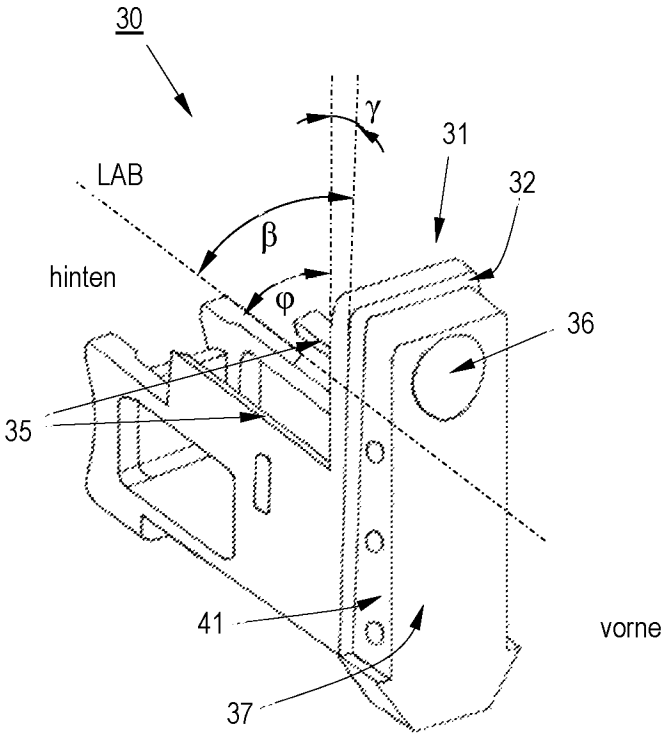
FIG. 2 is a perspective view of a fastening adapter in a view obliquely from behind (Figure (a)) and a view obliquely from the front (Figure (b))
Figure 2:
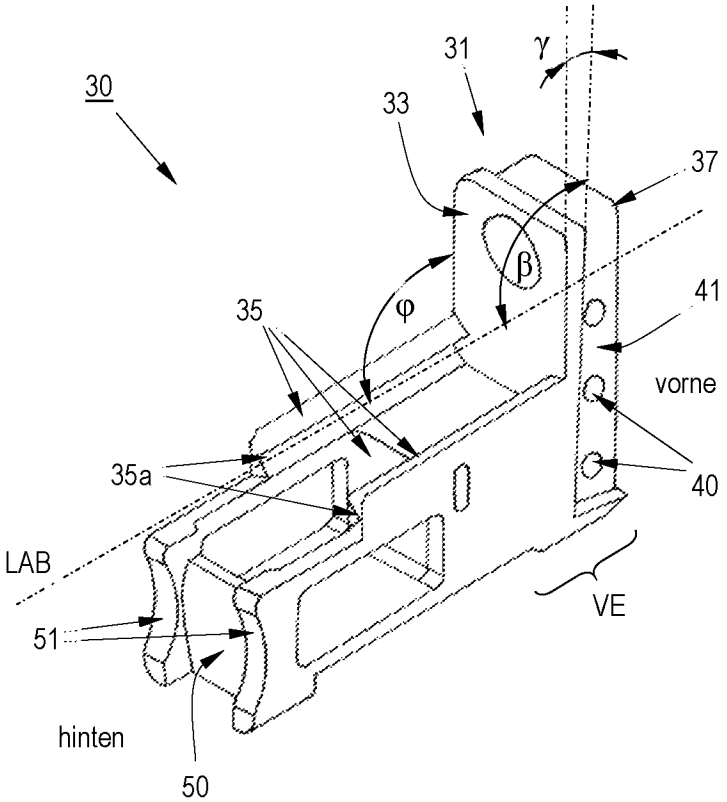

FIG. 2 shows the fastening adapter 30 according to the invention in a perspective view obliquely from the rear (sub-figure (a)) and a perspective view obliquely from the front (sub-figure (b)).

Visible here is the configuration of the rear end of the fastening rail 35 with the two wings 51 and the support surface extending between the wings 50.

Also clearly visible here is the front stop surface 32, which runs around the axial projection 37 around the side and the top.

At the top of the fastening rail 35, the fastening rail has two protruding, mutually parallel side walls, on the inside of each of which a longitudinal guide 35*a* is formed. In these longitudinal guides 35*a*, corresponding longitudinal guides of the mounting rail engage when pushing the silencer on the mounting rail of the weapon.

Figure 3:
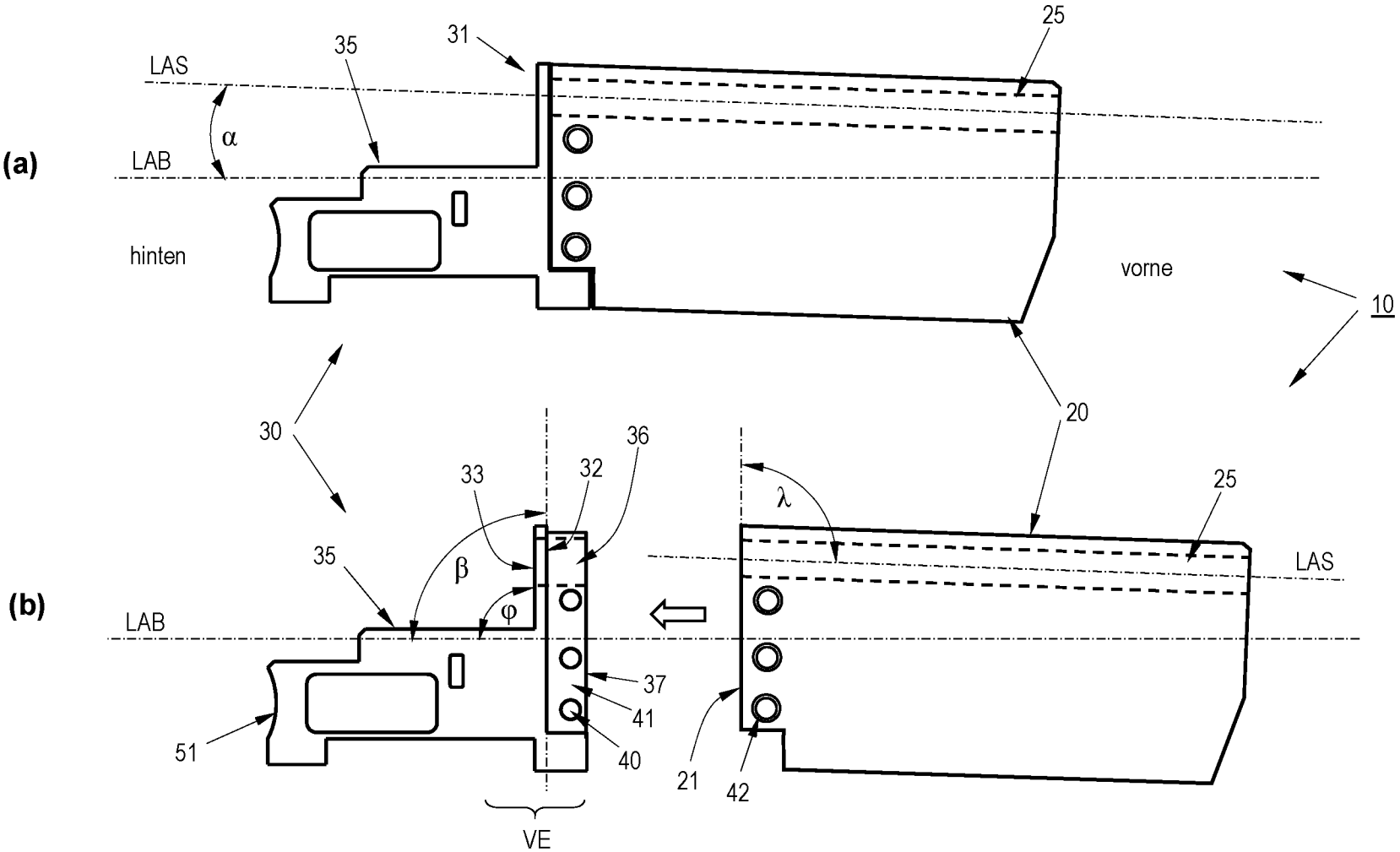
FIG. 3 is a side view of an alternative embodiment of a silencer according to the invention in an assembled state (Figure (a)) and in a disassembled state (Figure (b))

FIG. 3 shows an alternative embodiment of a silencer 10 according to the invention.

In contrast to the embodiment shown in FIG. 1, the angle β between the longitudinal axis LAB of the longitudinal guides 35*a* and the front stop surface 32 here is 90°. Following the comments on FIG. 1, the sum of the two angles β and λ must be between 180.2° and 181.4° or between 178.6° and 179.8°. Consequently, the angle λ between the rear end wall 21 of the silencer housing 20 and the longitudinal axis LAS of the shot channel is between 88.6° and 89.8° or between 90.2° and 91.4°. In the embodiment shown in FIG. 3, the angle λ is 90.8°, so that the shot channel 25 is inclined downward in the silencer housing by 0.8° relative to the longitudinal axis LAB.

Figure 4:
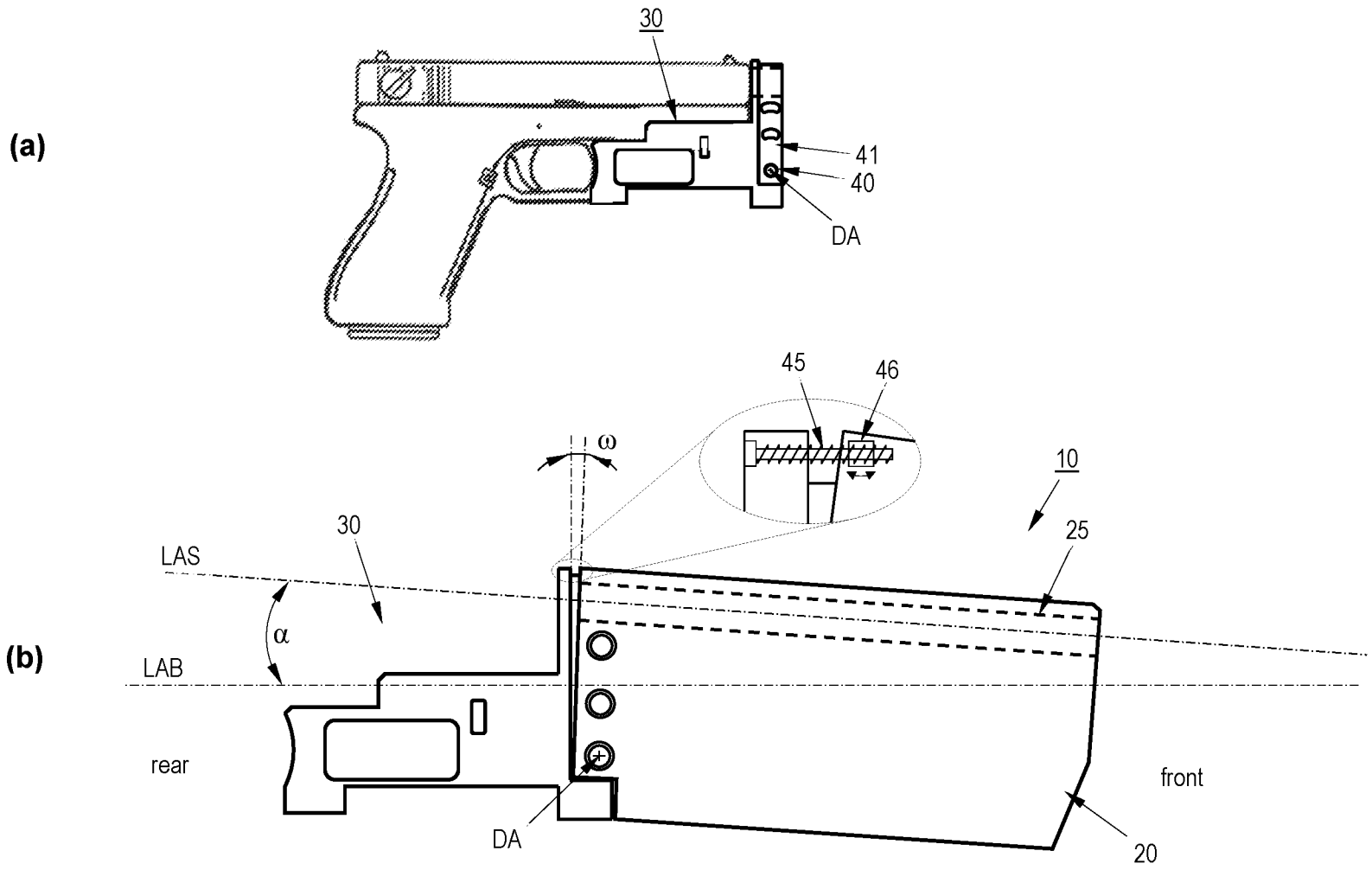
FIG. 4 is a further embodiment of a silencer according to the invention with a pivotally arranged silencer housing.

FIG. 4 shows another embodiment of a silencer 10 according to the invention with a pivotally mounted silencer housing 20.

In one embodiment of the silencer according to the invention, it may be provided that the angle α, i.e. the inclination angle of the longitudinal axis LAS, is adjustable relative to the longitudinal axis LAB.

For this purpose, provision may be made for the silencer housing 20 to be arranged on the fastening adapter 30 in such a way that the silencer housing can be pivoted about a rotational axis DA running transversely through the fastening adapter relative to the fastening adapter, preferably by a swivel angle ω between −1.4° and +1.4°.

The axis of rotation DA can here be formed by a fastening pin, which is passed through the lower through-holes 40 of the fastening adapter 30 and the lower through-holes 42 of the silencer housing 20. This fastening pin can be used simultaneously to lock the silencer housing 20 in a certain pivot angle ω.

The upper through-hole 40 and the two upper through-holes 40 of the fastening adapter 30 may be configured as a slot having a certain radius of curvature, as shown in sub-figure (a) of FIG. 4. Fasteners passed through the upper through-holes 42 of the silencer housing 20 then move during pivoting of the silencer housing 20 about the axis of rotation DA along the slots. With the help of the fastening means, which are passed through the elongated holes, the silencer housing can be locked in a certain pivot angle ω.

The adjustment of the pivot angle ω can also be accomplished by means of a locking screw 45 which is passed through the fastening plate 31 (preferably in the area of the front stop surface 32 above the projection 37) and engages in a threaded bushing 46 arranged on or in the rear end wall 21 of the silencer housing 20. The threaded bushing 46 is preferably rotatably mounted, so that the locking screw 45 can always engage vertically into the threaded bushing 46 independently of the swivel angle ω.

In the case of the silencers according to the invention, it is advantageous if between the projection 37 and the side walls in the rear portion of the silencer housing 20 a seal is arranged, which prevents escape of the blast gases.

REFERENCE NUMERALS

10 Silencer
20 Silencer housing of silencer 10
21 Rear end wall of the silencer housing 20
25 Shot channel in the silencer housing 20
30 Fastening adapter of the silencer 10
31 Fastening plate of the fastening adapter 30
32 Front stop surface of the fastening plate 31
33 Rear stop surface of the fastening plate 31
35 Fastening rail of the fastening adapter 30
35*a* Longitudinal guides of the fastening rail 35
36 Shot channel in the fastening plate 31 of the fastening adapter 30
37 Projection on the fastening plate 31
40 Through-holes, blind holes or the like on the projection 37 for fastening means, such as screws
41 Vertical side walls of the projection 37
42 Through-holes on the rear side walls of the silencer housing 20
45 Locking screw
46 Threaded bushing
50 Support surface at the rear end of the fastening rail 35
51 Wing at rear end of fastening rail 35
DA Rotation axis
LAB Longitudinal axis of the fastening rail 35
LAS Longitudinal axis of the shot channel 25
VE Front end of the fastening rail 35 and front end portion of the fastening adapter 30
α Angle between the longitudinal axis LAS of the shot channel 25 and the longitudinal axis LAB of the fastening rail 35
β Angle between the longitudinal axis LAB of the fastening rail 35 and the front stop surface 31 of the fastening adapter 30
γ Angle between the rear end wall 32 and the front stop surface 31 of the fastening adapter 30
φ Angle between the rear end wall 32 and the longitudinal axis LAB of the fastening rail 35, preferably 90°
λ Angle between the longitudinal axis LAS of the shot channel 25 and the rear end wall 21 of the silencer housing 20
ω Rotation or swivel angle

The invention claimed is:

1. Silencer (10) for a handgun, wherein the silencer has a fastening adapter (30) and a silencer housing (20), wherein the fastening adapter (30) comprises:

a fastening rail (35) with two mutually parallel longitudinal guides (35*a*) for fastening the fastening adapter to a mounting rail of a handgun, a front end (VE), and a fastening plate (31) arranged at the front end (VE) substantially perpendicular to a longitudinal guides longitudinal axis (LAB), the silencer housing (20) is releasably fastened to the fastening plate (31), thereby creating a fastened state, a first shot channel (25) is formed in the silencer housing (20), and in the fastened state of the silencer housing (20) to the fastening plate (31) a shot channel longitudinal axis (LAS) is inclined by a first angle (α) of between 0.2° and 1.4° relative to the longitudinal guides longitudinal axis (LAB) of the fastening rail (35).

2. A silencer according to claim 1, wherein the fastening plate (31) has a front stop surface (32) and a rear stop surface (33)

wherein the rear stop surface (33) faces a weapon barrel of a handgun in the fastened state of the fastening adapter (30) on a mounting rail of a handgun, and the silencer housing (20) has a rear end wall (21), which in the fastened state of the silencer housing (20) on the fastening plate (31) faces the front stop surface (32) of the fastening plate (31).

3. A silencer according to claim 2, where a second angle (β) is the angle between the front stop surface (32) and the longitudinal axis (LAB) of the longitudinal guides (35*a*), and a third angle (×) is the angle between the shot channel longitudinal axis (LAS) of the first shot channel (25) and the rear end wall (21), and wherein a sum of the angle (β) and the third angle (λ) (β+λ) is between 180.2° and 181.4° or between 178.6° and 179.8°.

4. A silencer according to claim 3, wherein the third angle (λ) is 90°, or the second angle (β) is 90°.

5. A silencer according to claim 2, wherein a fourth angle (φ) between the rear stop surface (33) and the longitudinal guides longitudinal axis (LAB) is 90°.

6. The silencer according to claim 1, wherein a second shot channel (36) is provided in the fastening plate (31), wherein the second shot channel (36) of the fastening plate (31)

extends in the attached state of the silencer housing (20) on the fastening plate (31) coaxial with the first shot channel (25) of the silencer housing (20), or parallel to the longitudinal guides longitudinal axis (LAB).

7. A silencer according to claim 6, wherein the second shot channel (36) of the fastening plate (31) is tapered towards the front stop surface (32) and has substantially the same diameter at the front stop surface (32) as the first shot channel (25) of the silencer housing (20).

8. The silencer according to claim 1, wherein on the front stop surface (32) an axial projection (37) is provided which engages largely positively in a corresponding recess on the rear end wall (21) of the silencer housing (20).

9. A silencer according to the claim 8, wherein on at least one side wall (41) of the axial projection (37) boreholes (40) or through-holes corresponding to boreholes on the silencer housing (20) may be provided for receiving fastening means.

10. The silencer according to claim 1, wherein the fastening rail (35) has a rear end, and at the rear end of the fastening rail (35) a support surface (50) is formed, which rests at least partially on a front end of a trigger guard of the handgun when the fastening adapter (30) is attached to the handgun.

11. The silencer according to claim 1, wherein the silencer housing (20) is pivotally mounted to the mounting adapter (30) at a predetermined fifth angle (ω) relative to the fastening adapter (30).

* * * * *